US011266244B2

(12) United States Patent
Barrett

(10) Patent No.: US 11,266,244 B2
(45) Date of Patent: Mar. 8, 2022

(54) CHAIR ASSEMBLY

(71) Applicant: Barrett Studios, Inc., Libertyville, IL (US)

(72) Inventor: Shawn Barrett, Libertyville, IL (US)

(73) Assignee: Barrett Studios, Inc., Libertyville, IL (US)

( * ) Notice: Subject to any disclaimer, the term of this patent is extended or adjusted under 35 U.S.C. 154(b) by 0 days.

(21) Appl. No.: 16/970,038

(22) PCT Filed: Feb. 15, 2019

(86) PCT No.: PCT/US2019/018171
§ 371 (c)(1),
(2) Date: Aug. 14, 2020

(87) PCT Pub. No.: WO2019/161168
PCT Pub. Date: Aug. 22, 2019

(65) Prior Publication Data

US 2021/0085082 A1 Mar. 25, 2021

Related U.S. Application Data

(60) Provisional application No. 62/631,580, filed on Feb. 16, 2018.

(51) Int. Cl.
*A47C 1/032* (2006.01)
*A47C 3/021* (2006.01)
(Continued)

(52) U.S. Cl.
CPC ..... *A47C 1/024* (2013.01); *A47C 1/03261* (2013.01); *A47C 3/04* (2013.01); *A47C 7/16* (2013.01)

(58) Field of Classification Search
CPC ..... A47C 1/024; A47C 1/03261; A47C 3/04; A47C 7/16
(Continued)

(56) References Cited

U.S. PATENT DOCUMENTS 1,915,480 A * 6/1933 Trainor ..... A47C 3/021 297/294 X
1,928,939 A * 10/1933 Larsen ..... A47C 3/021 297/295
(Continued)

FOREIGN PATENT DOCUMENTS

DE 202012000262 U1 * 2/2012 ..... A47C 7/16
EP 3656252 A1 * 5/2020 ..... A47C 5/12
(Continued)

OTHER PUBLICATIONS

PCT International Search Report from PCT/US2019/018171, dated Apr. 19, 2019.

*Primary Examiner* — Rodney B White
(74) *Attorney, Agent, or Firm* — Boyle Fredrickson, S.C.

(57) ABSTRACT

Stackable or nestable single person seating assemblies that include a leg support defined by a plurality of legs and a crossbar that extends between the plurality of legs. The seat assembly includes a back that is rotatably coupled to the plurality of legs and a seat that is rotatably coupled to the back. A biasing element extends from the leg support to the seat and is coupled to a respective leg. Respective portions of the biasing element provide a third pivot axis and a fourth pivot axis that are activated when the back is reclined relative to the seat.

19 Claims, 12 Drawing Sheets

(51) Int. Cl.
*A47C 1/024* (2006.01)
*A47C 3/04* (2006.01)
*A47C 7/16* (2006.01)

(58) Field of Classification Search
USPC ..... 297/285, 294, 295, 446.1, 446.2, 447.4, 297/451.3, 451.7, 286, 287
See application file for complete search history.

(56) References Cited

U.S. PATENT DOCUMENTS 2,006,421 A * 7/1935 Trainor ..... A47C 3/021 297/287
2,034,412 A * 3/1936 Neutra ..... A47C 3/021 297/451.7 X
2,035,489 A * 3/1936 McArthur, Jr. ..... 297/447.4 X
2,080,607 A * 5/1937 Galante ..... A47C 3/021 297/287
2,084,310 A * 6/1937 Breuer ..... A47C 3/021 297/295
2,135,833 A * 11/1938 Oermann ..... A47C 3/021 297/287
2,241,115 A * 5/1941 Burke ..... A47C 3/023 297/295
2,273,980 A * 2/1942 Moody ..... A47C 3/021 297/287
2,532,025 A * 11/1950 Johnson ..... A47C 3/021 297/286
2,557,671 A * 6/1951 McDonald ..... A47C 3/021 297/287
2,586,951 A * 2/1952 Johnson ..... A47C 3/021 297/286
2,695,655 A * 11/1954 Gould ..... A47C 3/023 297/295
2,823,732 A * 2/1958 Humphrey ..... A47C 1/024 297/320
3,069,204 A * 12/1962 Vesterholt ..... A47C 3/12 297/451.3 X
3,332,718 A * 7/1967 Reinhold ..... A47C 3/021 297/294 X
3,411,822 A * 11/1968 Borenstein ..... A47C 3/0252 297/294
3,594,041 A * 7/1971 Rye ..... A47C 3/023 297/451.3
3,743,352 A * 7/1973 Kallander ..... A47C 3/021 297/285
3,815,955 A * 6/1974 Gibilterra ..... A47C 3/023 297/295
4,097,089 A * 6/1978 Petersen ..... A47C 3/023 297/451.7 X
4,522,444 A * 6/1985 Pollock ..... A47C 3/04 297/239
4,542,938 A * 9/1985 Tisbo ..... A47C 3/023 297/295
4,618,185 A * 10/1986 Kaufman ..... A47C 1/029 297/285
4,674,795 A * 6/1987 Nelson ..... A47C 3/023 297/294 X
4,690,459 A * 9/1987 Ullman ..... A47C 9/005 297/451.3 X
4,787,672 A * 11/1988 Werner ..... A47C 3/021 297/294 X
4,880,272 A * 11/1989 Brauning ..... A47C 7/445 297/296
4,938,530 A * 7/1990 Snyder ..... A47C 3/023 297/287
5,123,702 A * 6/1992 Caruso ..... A47C 3/12 297/440.21
5,383,712 A * 1/1995 Perry ..... A47C 1/032 297/451.7 X
5,823,626 A * 10/1998 Haas ..... A47C 1/03277 297/448.2
RE36,335 E * 10/1999 Perry ..... A47C 1/032 297/295 X
6,056,361 A * 5/2000 Cvek ..... A47C 7/46 297/446.2
6,224,159 B1 * 5/2001 Perry ..... A47C 1/032 297/448.2 X
6,412,869 B1 * 7/2002 Pearce ..... A47C 7/405 297/294
6,634,717 B2 * 10/2003 Kown ..... A47C 3/023 297/294 X
6,722,735 B2 4/2004 Lucci et al.
6,837,539 B1 * 1/2005 Casey ..... A47C 7/70 297/294 X
6,896,329 B2 5/2005 Sander et al.
6,935,690 B2 8/2005 Lucci et al.
7,073,864 B2 * 7/2006 Olsen ..... A47C 3/023 297/447.1 X
7,273,253 B2 9/2007 Deimen et al.
7,490,902 B2 2/2009 Aubert
7,775,590 B2 * 8/2010 Shen ..... A47C 4/028 297/287
7,850,241 B1 12/2010 Lucci et al.
8,256,845 B2 * 9/2012 Wang ..... A47C 5/02 297/446.1
8,272,693 B2 9/2012 Hall et al.
8,616,640 B2 12/2013 van Hekken
8,757,725 B2 * 6/2014 Schneider ..... A47C 3/023 297/451.3
8,888,182 B2 * 11/2014 Ivicevic ..... A47C 1/024 297/294
9,004,597 B2 4/2015 Battey et al.
9,010,859 B2 4/2015 Battey et al.
9,022,476 B2 5/2015 Battey et al.
9,027,997 B2 5/2015 Battey et al.
9,027,998 B2 5/2015 Battey et al.
9,027,999 B2 5/2015 Battey et al.
9,028,001 B2 5/2015 Battey et al.
9,049,935 B2 6/2015 Battey et al.
9,055,817 B2 * 6/2015 Weber ..... A47C 7/443
9,107,504 B2 * 8/2015 Haas ..... A47C 3/04
9,237,809 B2 * 1/2016 Kassanoff ..... A47C 3/00
9,451,826 B2 9/2016 Battey et al.
9,462,888 B2 10/2016 Battey et al.
9,526,339 B2 12/2016 Battey et al.
9,814,316 B2 * 11/2017 Kassanoff ..... A47D 1/00
2003/0090139 A1 * 5/2003 Kown ..... A47C 7/62 297/446.2 X
2003/0214172 A1 * 11/2003 Bosman ..... A47C 7/68 297/446.2
2003/0227210 A1 * 12/2003 Bosman ..... A47C 7/68 297/446.2
2004/0104613 A1 * 6/2004 Bosman ..... A47C 7/68 297/451.3
2004/0251729 A1 12/2004 Olson
2006/0103198 A1 * 5/2006 Dettmann ..... A47C 7/405 297/446.2 X
2010/0244515 A1 * 9/2010 Ivicevic ..... A47C 3/023 297/239
2012/0153700 A1 6/2012 Weber et al.
2013/0300079 A1 11/2013 Haas
2014/0077540 A1 3/2014 Peterson et al.
2015/0265053 A1 9/2015 Battey et al.

FOREIGN PATENT DOCUMENTS

FR 2627968 A1 * 9/1989 ..... A47C 1/03261
JP 2014097178 A 5/2014

* cited by examiner

CHAIR ASSEMBLY

CROSS-REFERENCE TO RELATED APPLICATIONS

This application claims priority to PCT Application No. PCT/US2019/018171, filed on Feb. 15, 2019, which claims priority to U.S. Provisional Application No. 62/631,580, filed on Feb. 16, 2018. The entire contents of each are hereby expressly incorporated by reference into this application.

BACKGROUND OF THE INVENTION

Weight-responsive pivoting chairs are used to control tilting of a seat and back assembly for the chair in order to increase comfort for the user. In some chair assemblies, the chair back reclines, while the chair seat remains horizontal. In other chair assemblies, the chair back and the chair seat are able to move in sync with each other. Most pivoting chairs utilize complex mechanisms located under the seat to control the movement of the chair back and the chair seat. These designs result in a chair assembly that is expensive to manufacture. In addition, the complex mechanisms reduce the ability to stack and conveniently store the chair assemblies.

As such, there is a need in the art for a chair assembly having an improved weight-activated pivoting system with multiple pivot points and a biasing element extending between the seat and the legs of the chair assembly. Additionally, there is a need in the art for an improved pivoting chair assembly that is also easily stackable.

SUMMARY OF THE INVENTION

The invention is related to a chair assembly, and, in particular, to a chair assembly that is configured to be stackable yet provide a degree of recline of a back portion relative to a seat portion during use of the same.

In accordance with one aspect of the application, a chair assembly includes a leg support having a plurality of legs and a crossbar that extends between the plurality of legs. A back is rotatably coupled to the leg support via a first pivot and a seat is rotatably coupled to the back via a second pivot. A biasing element extends from the leg support to a lower portion of the seat and includes a plurality of base portions that are coupled to the leg assembly. The biasing element includes a lower bend section that transitions to an extension portion and an upper bend section that transitions each extension portion to a raised portion that is aligned with a lower portion of the seat. The upper bend provides a third pivot and the lower bend provides a fourth pivot that are activated when the back reclines relative to the seat.

According to another aspect of the application, a force applied to the back causes the back to pivot about the first pivot, the back and seat to pivot about the second pivot, the seat and biasing element to pivot about the third pivot point, and the biasing element to pivot about the fourth pivot point.

In accordance with another aspect of the invention, a chair assembly includes a leg assembly with a plurality of legs and a support member extending inward from at least two of the legs. A back is rotatably coupled to the leg assembly via a first pivot axis, and a seat is rotatably coupled to the back via a second pivot axis. A biasing element extends between the leg assembly to the seat. The biasing element includes a raised portion extending horizontally under the seat and a plurality of upper bend portions that transitions the raised portion to a plurality of extension portions. Each extension portion extends from a respective upper bend section to a location adjacent a respective support member. The upper bend portions provide a third pivot axis, while the location adjacent the support member provides a fourth pivot axis.

According to yet another aspect of the invention, the biasing element may also include a lower bend portion that transitions each extension portion to a base portion. In turn, each base portion is coupled to an inner surface of a respective leg. In this aspect of the invention, the fourth pivot axis is defined by the lower bend portions. Further, the support member may be a crossbar extending between at least two of the legs or a plurality of protrusions extending inward from at least two of the legs.

According to another aspect of the invention, a crossbeam extends between at least two of the legs at a location adjacent a top end of each leg, and a support is coupled to the crossbeam. A channel is formed in the lower surface of the seat, and a distal end of the support extends into the channel. A flex member is coupled to and extends between the distal end of the support and an inner edge of the channel. As a result, pivoting of the chair assembly about the first, second, third, and fourth pivot axes causes the flex member to expand as the distal end of the support and the inner edge of the channel are displaced and causes the flex member to contract as the distal end of the support and the inner edge of the channel are brought closer together.

In accordance with yet another aspect of the invention, a chair assembly includes a plurality of legs and a support member extending inward from at least one leg. A back is rotatably coupled to the leg assembly to provide a first pivot axis. A seat is rotatably coupled to the back to provide a second pivot axis. Further, a biasing element extends from the seat at a third pivot axis to a location adjacent the support member at a fourth pivot axis.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE FIGURES

A clear conception of the advantages and features constituting the present invention will become more readily apparent by referring to the exemplary, and therefore non-limiting, embodiments illustrated in the drawings accompanying and forming a part of this specification, wherein like reference numerals designate the same elements in the several views.

In the drawings.

DETAILED DESCRIPTION OF THE FIGURES

Figure 1:
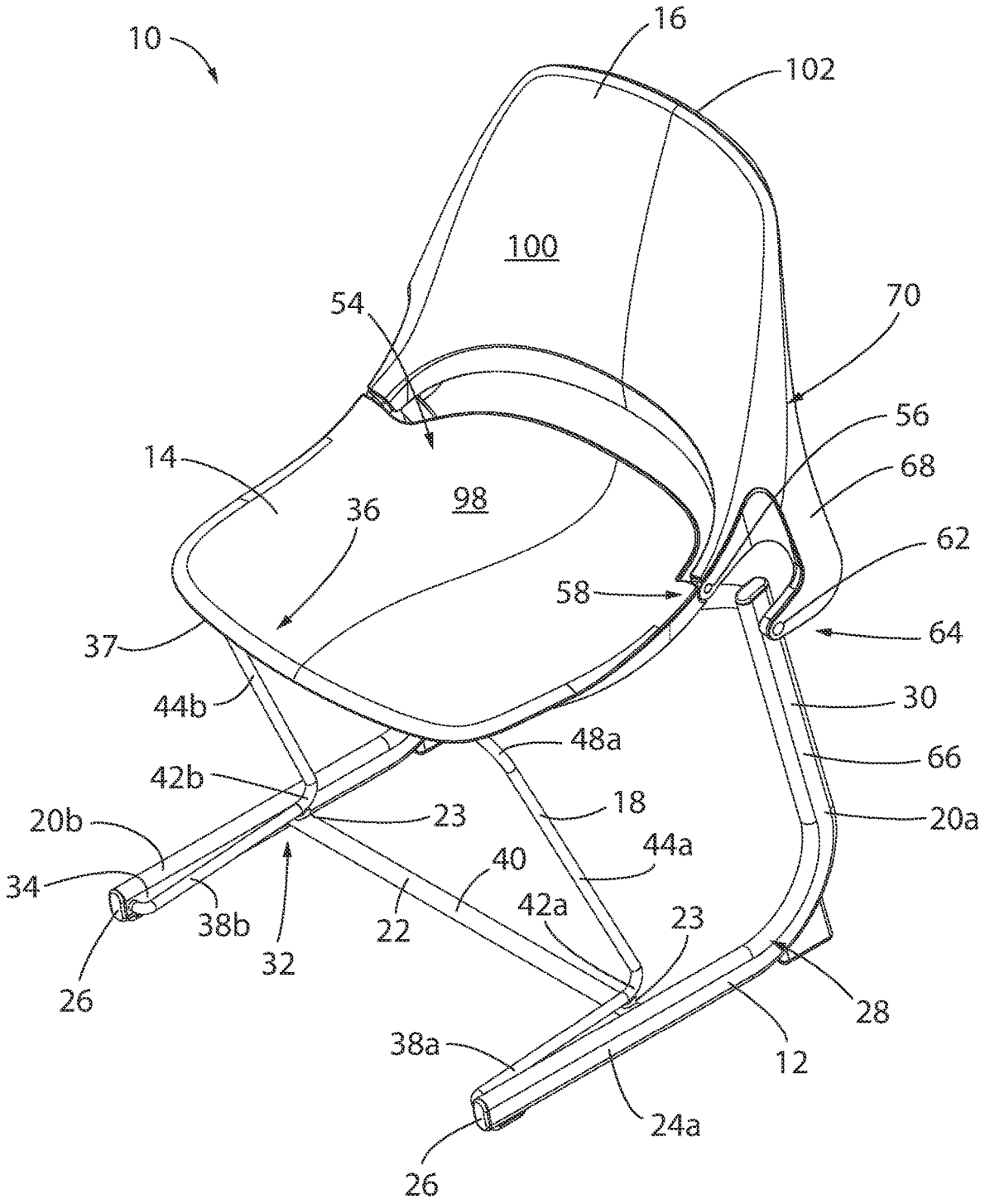
FIG. 1 is a perspective view of a chair assembly according to the present application.
Figure 2:
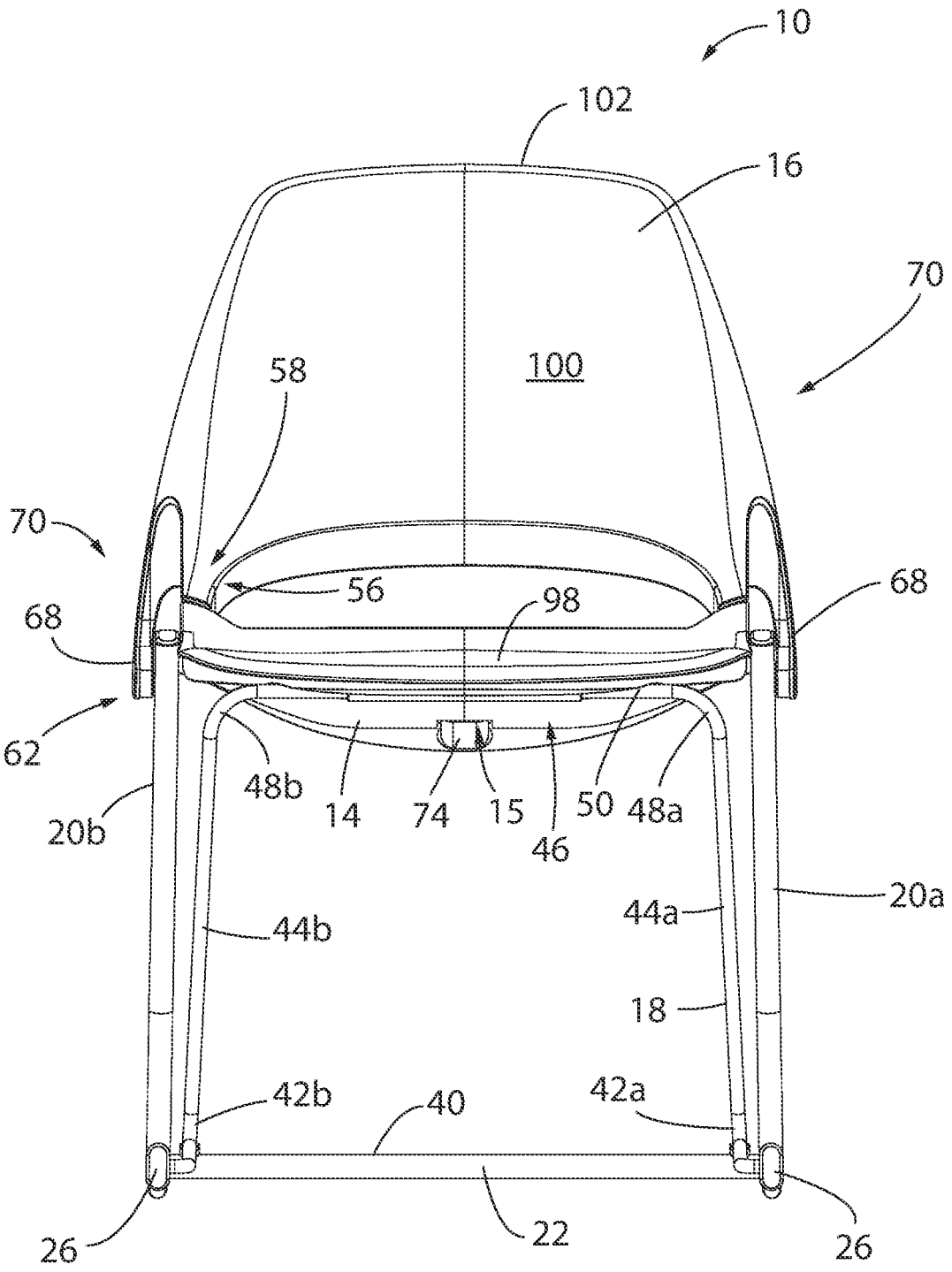
FIG. 2 is a front elevation view of the chair assembly of FIG. 1.
Figure 3:
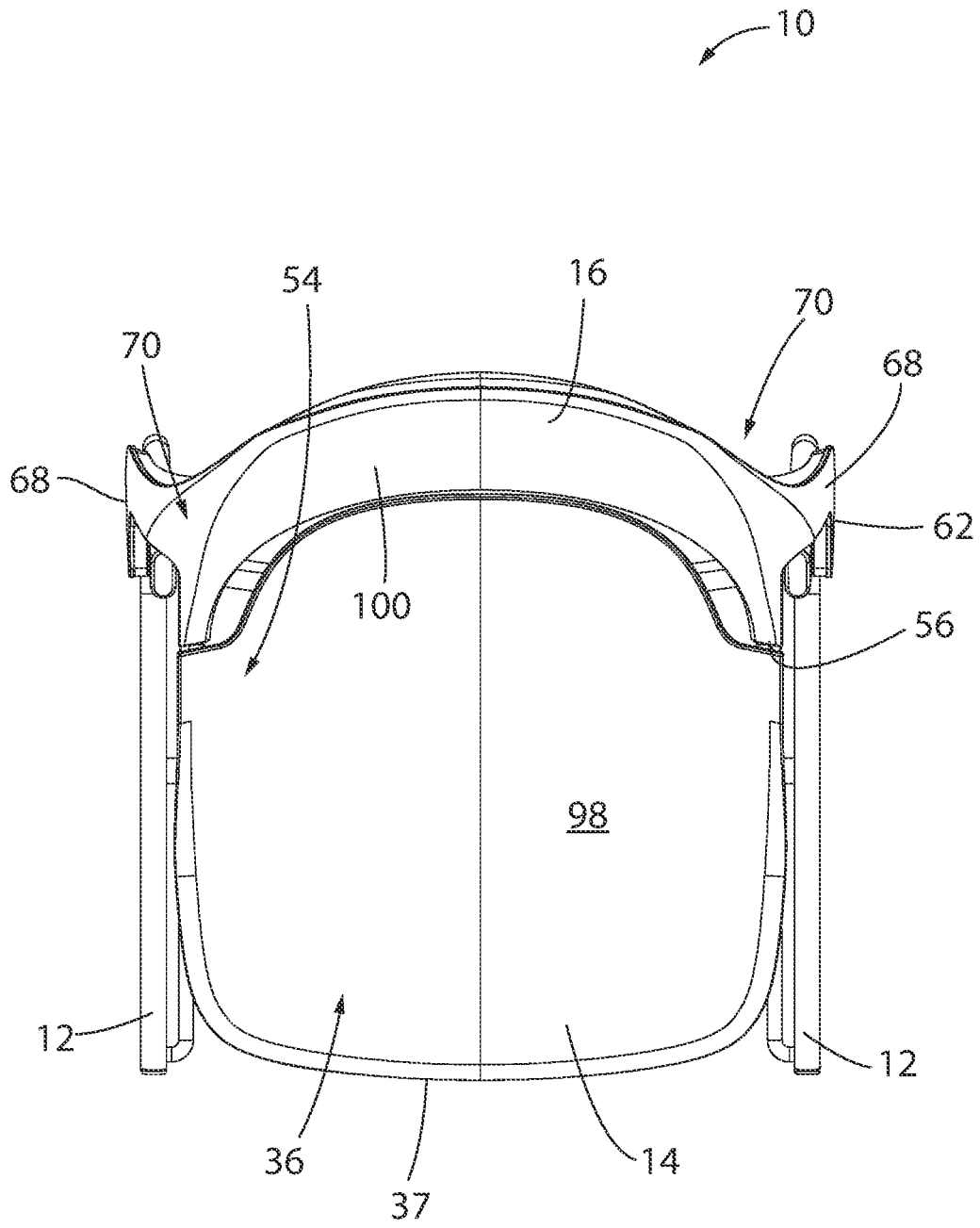
FIG. 3 is a top plan view of the chair assembly of FIG. 1.

The present invention and the various features and advantageous details thereof are explained more fully with reference to the non-limiting embodiments described in detail in the following description.

FIGS. 1-5 are respective perspective, front, top, bottom, and rear views of a chair assembly 10 according to one embodiment of the present application. The chair assembly 10 includes a leg assembly or leg support 12, a seat 14, a back 16, and at least one biasing element 18. In the representative embodiment of the invention, the leg support 12 includes two (2) L-shaped legs 20*a*, 20*b* and a support member 22, such as a crossbar 22, extending between the legs 20*a*, 20*b*. In other embodiments of the invention, the leg support 12 may include any number of legs 20 having any shape. It is further appreciated that leg support 12 can be formed as a continuous wire form member or discrete members that are respectively secured to one another. Leg support 12 is formed of a metal material although other materials are envisioned such as carbon or other fiber materials as well as ferrous and non-ferrous metal materials. Similarly, biasing element 18 is formed of a metal material but it is contemplated that other materials such as carbon, other fiber materials, plastics, polymers, and other ferrous and non-ferrous metal materials may be used.

As shown in FIG. 1, each leg 20 includes a base section or portion 24 having a first end 26 and a second end 28. The leg 20 further includes a leg section or portion 30 extending from the second end 28 of the base portion 24. In the representative embodiment of the invention, the leg portion 30 extends from the base portion 24 at an angle between 45° and 90°. However, it is contemplated that the leg portion 30 may extend from the base portion 24 at any angle, in other embodiments of the invention. The crossbar 22 extends between the base portion 24 of each leg 20 at a location 32 between the first and second ends 26, 28 of the respective base section or portion 24.

The biasing element 18 extends from an inner surface 34 of each leg 20 to a front portion 36 of the seat 14. For example, the biasing element 18 may be a tension bar. In the representative embodiment of the invention, the biasing element 18 is coupled to the inner surface 34 of each leg 20 adjacent the first end 26 of the base portion 24 of the leg 20*a*. Alternatively, it is appreciated that biasing element 18 may cooperate with an outer lateral surface of each leg 20. The biasing element 18 includes a base section or portion 38 extending from each leg 20 toward the crossbar 22, so as to rest upon or be spaced apart from a top surface 40 of the crossbar 22 adjacent the base portion 24 of the respective leg 20. At a lower bend section or portion 42 adjacent the crossbar 22, the biasing element 18 then transitions to an extension section or portion 44 extending upward from each base portion 38 and toward the front portion 36 of the seat 14. The base and extension portions 38, 44 of the biasing element 18 are oriented generally along a vertical plane although it is appreciated that the extension portions 38, 44 of biasing element 18 may have a canted or crossing orientation relative to a gravitationally vertical orientation. At an upper bend section or portion 48 adjacent the seat 14, the biasing element 18 then transitions to a raised section or portion 50 that extends preferably in a perpendicular orientation relative to the extension portions 44 and along a lower surface 46 of the seat 14 at the front portion 36 of the seat 14. The raised portion 50 of the biasing element 18 is preferably oriented along a horizontal plane that extends under the seat 14.

As stated above, the biasing element 18 includes a base section or portion 38, a lower bend section or portion 42, an extension section or portion 44, and an upper bend section or portion 48 associated with each leg 20. Each extension portion 44 transitions to the raised portion 50 of the biasing element 18 at its respective upper bend portion 48. That is, the raised portion 50 extends between the upper bend portions 48. For example, in the representative embodiment of the invention shown in FIGS. 1-4, the biasing element 18 includes a base section or portion 38*a* that is coupled to a leg 20*a*, a lower bend section or portion 42*a* that is disposed at the crossbar 22 adjacent leg 20*a*, and an extension section or portion 44*a* extending to an end of the raised portion 50. The biasing element 18 also includes a base portion 38*b* coupled to a leg 20*b*, a lower bend section or portion 42*b* disposed at the crossbar 22 adjacent the leg 20*b*, and an extension section or portion 44*b* extending to the opposite end of the raised portion 50. In a preferred embodiment, biasing element 18 is formed as an elongated continuous wire form member although other constructions are envisioned such as a plurality of discrete members that are secured to one another.

Regardless of the specific construction methodology employed, in one embodiment of the invention, the biasing element 18 includes two (2) base portions 38, two (2) lower bend sections or portions 42, two (2) extension sections or portions 44, two (2) upper bend sections or portions 48, and one (1) raised section or portion 50. In other embodiments of the invention, the biasing element 18 may include other numbers of base portions 38, other numbers of lower bend sections or portions 42, other numbers of extension sections or portions 44, other numbers of upper bend sections or portions 48, and other numbers of raised section(s) or portion(s) 50. In yet another alternative embodiment of the invention, the biasing element 18 may include a raised portion 50, upper bend sections 48, and extensions portions 44. In such an embodiment of the invention, the extension portions 44 may be directly coupled to the crossbar 22. Details of such alternate embodiments are disclosed further below with respect to FIGS. 11 and 12.

Figure 6:
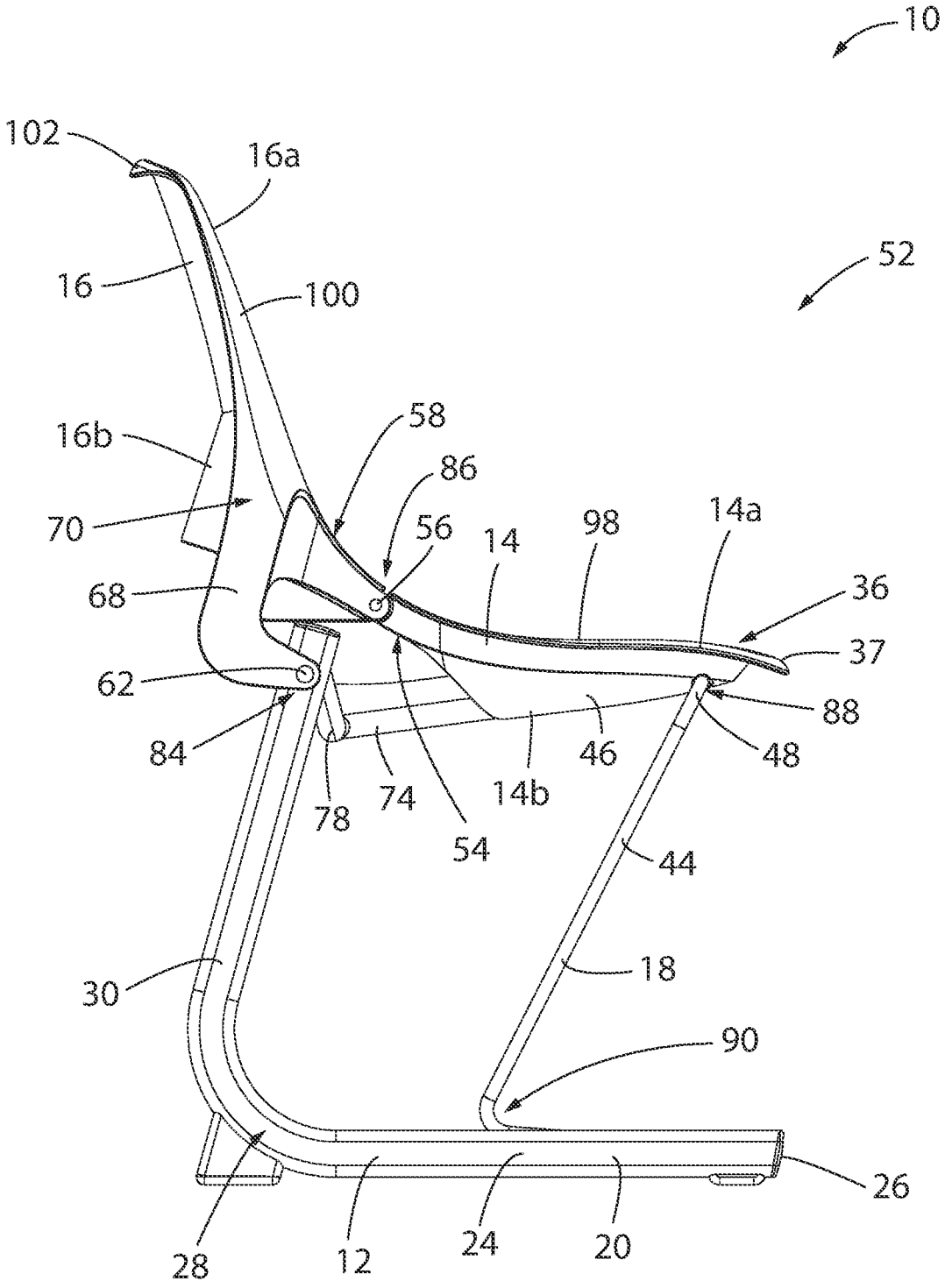
FIG. 6 is a right side elevation view of the chair assembly of FIG. 1 in a first at-rest or upright position.

As shown in FIG. 6, and regardless of the specific methodology associated with the construction of the biasing element, the extension portions, and the crossbar, biasing element 18 is configured to support the front portion 36 of the seat 14 and also provide a biasing force to maintain the chair assembly 10 in an upright at-rest or unloaded position 52. While FIG. 1 illustrates the biasing element 18 as having five (5) portions 38, 42, 44, 48, 50, it is contemplated that the biasing element 18 may have any number of portions to extend from the front section or portion 26 of the seat to either the base section or portion 24 of each leg 20 or the support member 22.

Figure 7:
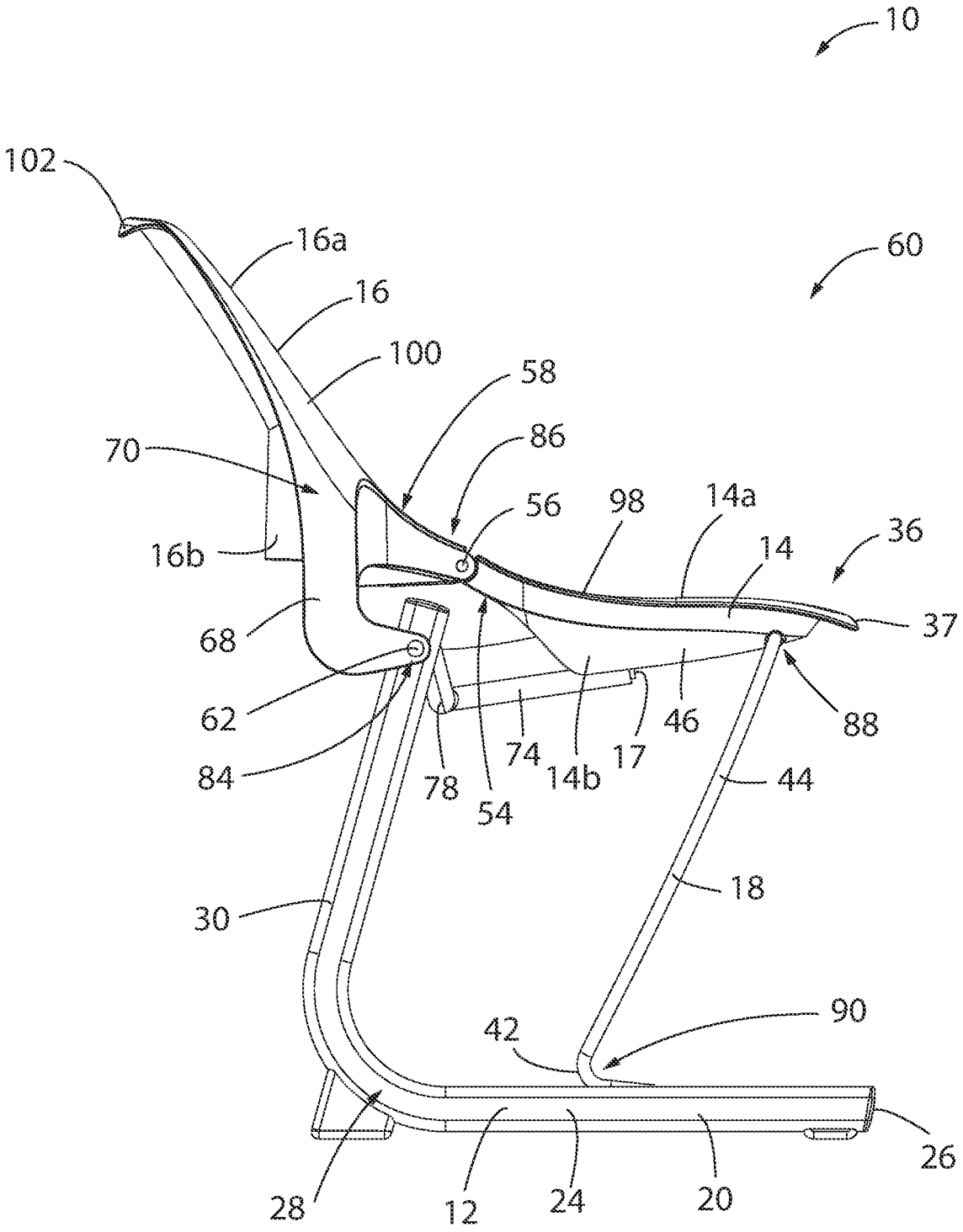
FIG. 7 is a view similar to FIG. 6 of the chair assembly of FIG. 1 in a second, reclined position.

As shown in FIGS. 1, 6, and 7, a rear portion 54 of the seat 14 is rotatably coupled to the back 16 of the chair assembly 10 at a number of pivots or pivot joints 56. The pivot joints 56 may further be located at a lower portion 58 of the back 16. While the representative embodiment of the invention depicts the use of two (2) pivot joints 56, it is contemplated that varying embodiments of the invention may use any number of pivot joints 56. Preferably, discrete pivot joints 56 are coaxial with one another along a pivot axis 86 that extends as an imaginary line between the generally opposite lateral right hand and lateral left hand sides of chair assembly 10.

Pivot joints 56 facilitate translation of motion of the back 16 into corresponding motion of the seat 14 to transfer the chair assembly from the at-rest or unloaded orientation 52—as shown in FIG. 6—to a loaded, biased, or a reclined orientation or position 60—as shown in FIG. 7. The movement of the back 16 and seat 14 of the chair assembly during transition of chair assembly 10 from the upright position 52 to the reclined position 60 is disclosed in further detail below.

The back 16 may also be rotatably coupled to each leg support 12 via a pivot or pivot joint 62. Each pivot joint 62 is preferably disposed at a location 64 on an outer surface 66 of each leg 20. Preferably, discrete pivot joints 62 are coaxial with one another along a pivot axis 84. In the representative embodiment of the invention, the back 16 includes an extension member 68 that extends from each side 70 of the back 16 to the location 64 on the outer surface 66 of the leg portion 30 of a respective leg 20. In the representative embodiment of the invention, location 64 is adjacent a top end 72 of the leg portion 30 however it is appreciated that location 64 may be disposed at any point along the length of the leg portion 30 of the leg 20. The multiple pivotable connections between back 16 and legs 20, back 16 and seat 36, and seat 36 and legs 20 allows the back 16 and seat 36 of the chair assembly 10 to rotate between the upright position 52 shown in FIG. 6 and the reclined position 60 shown in FIG. 7 in response to forces exerted on back 16 via a user associated with seat 36.

Figure 4:
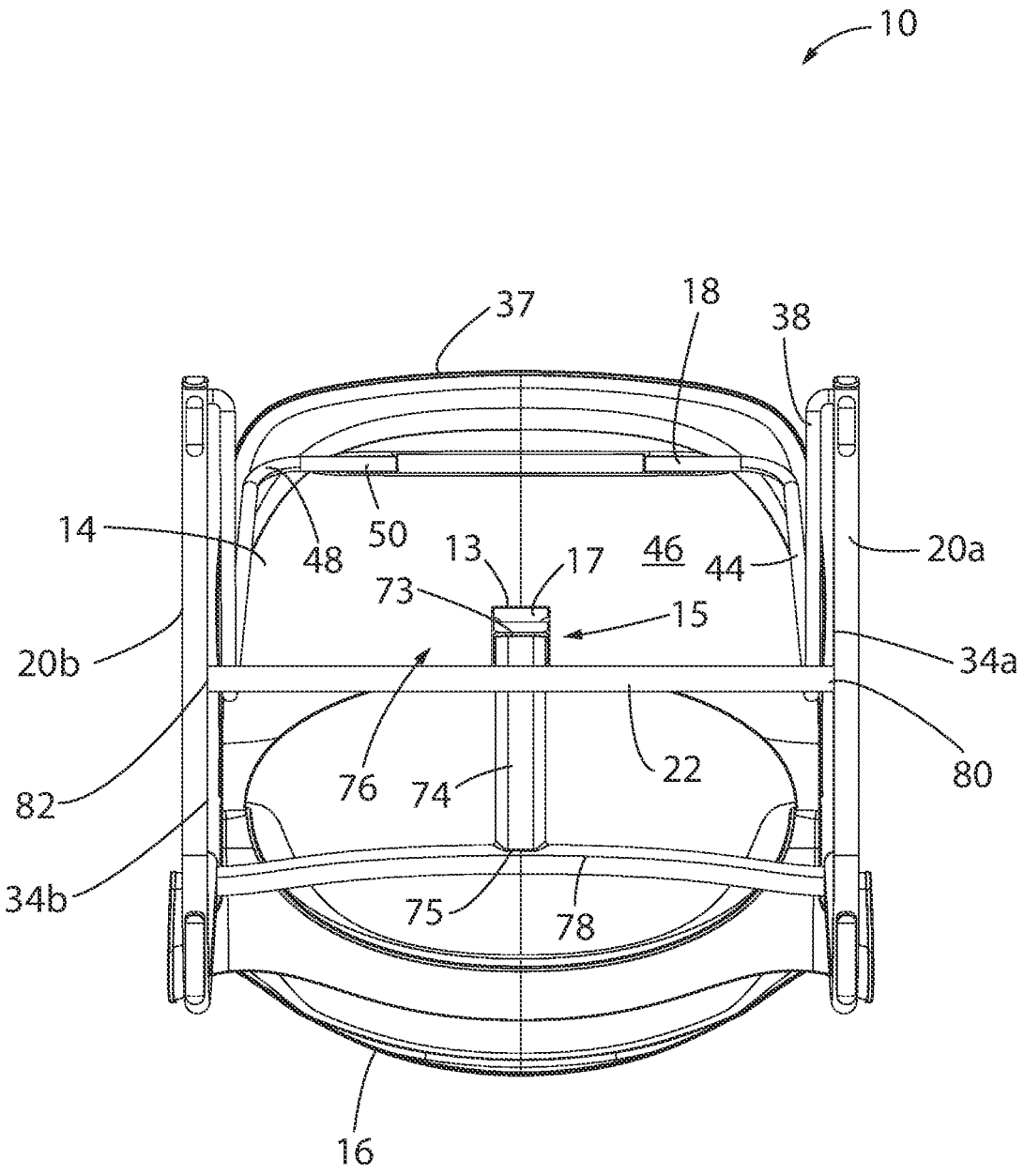
FIG. 4 is a bottom plan view of the chair assembly of FIG. 1.
Figure 5:
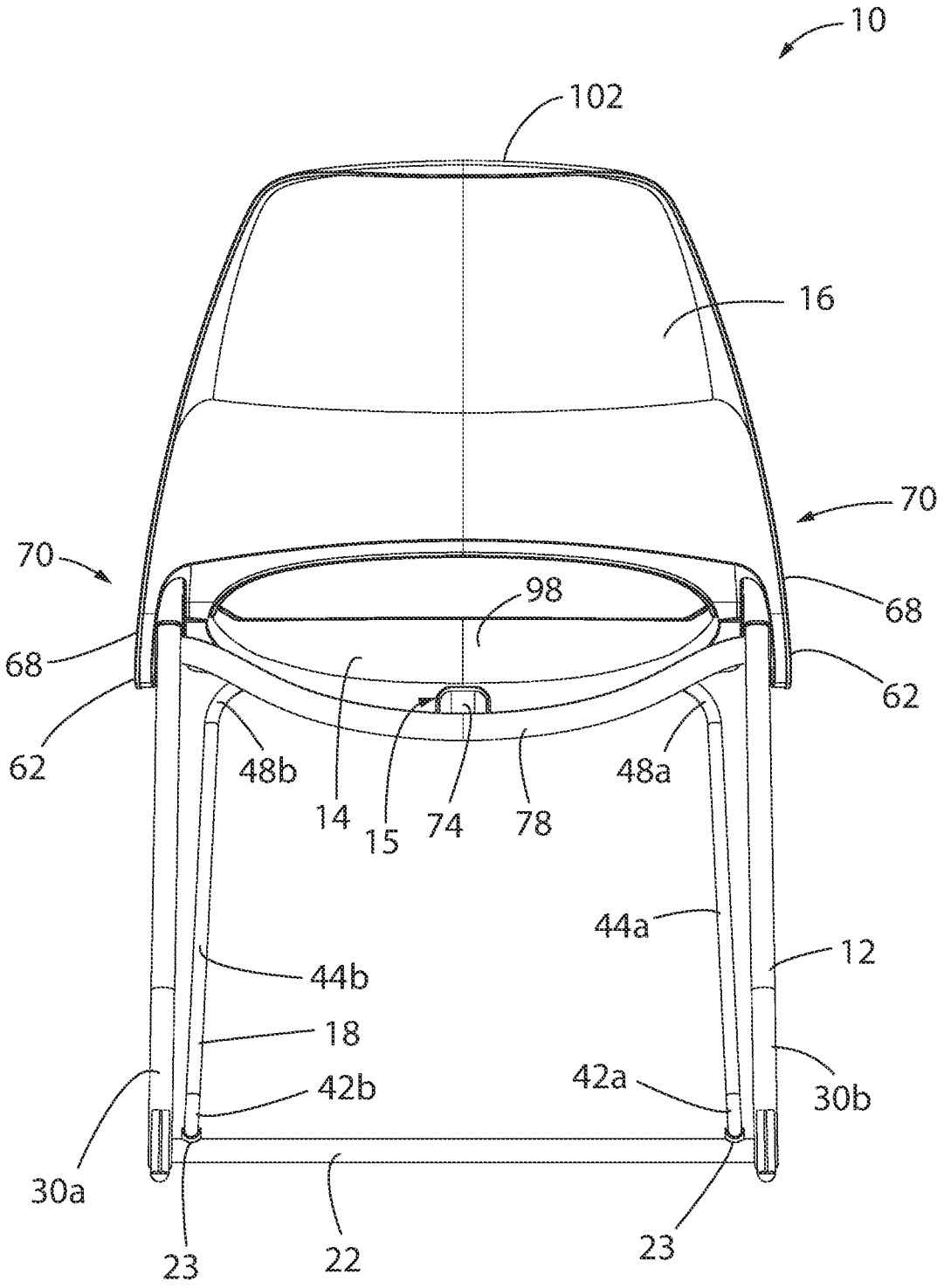
FIG. 5 is a rear plan view of the chair assembly of FIG. 1.
Figure 8:
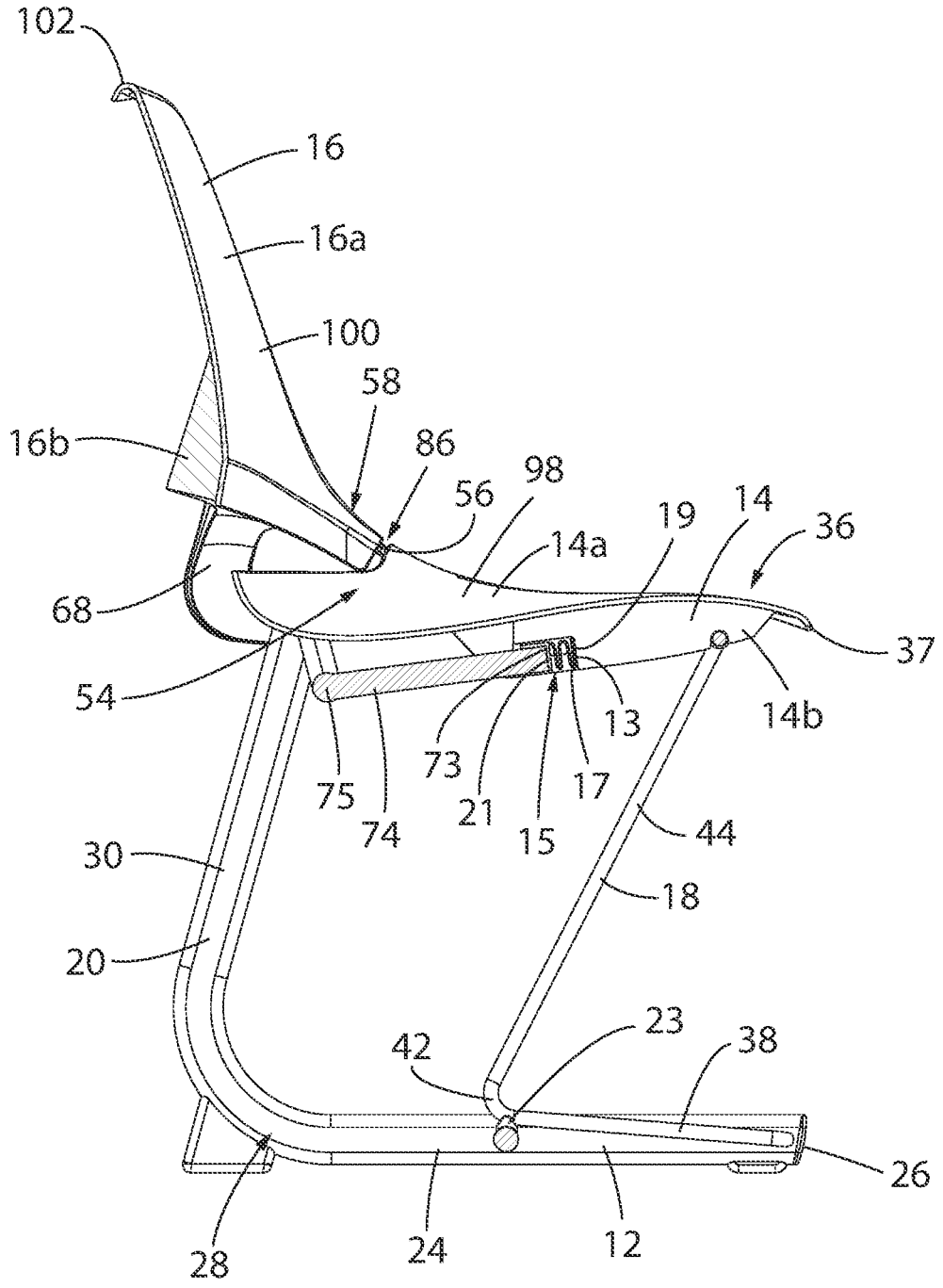
FIG. 8 is a cross-sectional view of the chair assembly of FIG. 1.

Referring to FIGS. 4, 5, and 8, a support extension 74 extends from a central location 76 of the lower surface 46 of the seat 14 to a crossbeam 78. The crossbeam 78 extends between the legs 20*a*, 20*b*. In the representative embodiment of the invention, the crossbeam 78 extends from a first end 80 coupled to leg 20*a* adjacent the top end 72 of the leg portion 30 to a second end 82 coupled to leg 20*b* adjacent the top end 72 of the leg portion 30. The support extension 74 and crossbeam 78 provide additional support for the seat 14 and a user seated thereupon.

FIG. 8 depicts a cross-sectional view of the chair assembly 10 to further illustrate the support extension 74. In the representative embodiment of the invention, the seat 14 may include a channel 15 formed in the lower surface 46 thereof at location 76. A first end 73 of the support extension 74 is disposed within the channel 15, while a second end 75 of the support extension 74 is coupled to the crossbeam 78. In the representative embodiment of the invention, a flex member 17 is disposed within the channel 15 to variably space apart the first end 73 of the support extension 74 from an inner end 13 of the channel 15.

The flex member 17 includes a first end 19 coupled to the inner end of the channel 13 and a second end 21 coupled to the first end 73 of the support extension. As shown in FIG. 8, the second end 21 of the flex member 17 may be in the form of bracket to partially surround the support extension 74. In other embodiments of the invention, the second end 21 of the flex member 17 may be a vertical plate to provide a backstop for the support extension 74 without surrounding it.

As stated above, the flex member 17 variably spaces the first end 73 of the support extension 74 from the inner end 13 of the channel 15. In other words, the flex member 17 is configured to expand as the first end 73 of the support extension 74 moves further away from the inner end 13 of the channel 15, while being configured to compress as the first end 73 of the support extension 74 moves closer to the inner end 13 of the channel 15.

As shown in FIG. 7, when the chair assembly 10 is transitioned to the reclined position 60, the movement of the seat 14 results in the support extension 74 being spaced apart from the channel 15, as the support extension 74 remains stationary. In turn, the inner end 13 of the channel 15 moves away from the first end 73 of the support extension 74 as the chair assembly 10 transitions from the upright position toward the reclined position 60. In the representative embodiment of the invention, the flex member 17 remains coupled to both the first end 73 of the support extension 74 and the inner end 13 of the channel 15. As a result, the flex member 17 protects a user and user apparel from pinching action between the support extension 74 and the channel 15 during transitioning of the chair assembly 10. It should also be noted that the support extension 74 in its entirety is also being spaced apart from the channel 15 in its entirety, as the seat 14 moves during transitioning to the reclined position 60.

FIG. 8 further illustrates the alignment of the lower bend 42 of the biasing element 18 and the crossbar 22. In the representative embodiment of the invention, a spacer 23 is disposed between the biasing element 18 and the crossbar 22. The spacer 23 may be formed from plastic or any other material.

Pivot joints 62, 56 provide a first pivot, pivot axis, or pivot point 84 and a second pivot, pivot axis, or pivot point 86, respectively for the chair assembly 10. A third pivot, pivot axis, or pivot point 88 and a fourth pivot, pivot axis, or pivot point 90 are provided along the biasing element 18. The third pivot point 88 is disposed at the upper bends 48 of the biasing element 18. The fourth pivot point 90 is disposed at the lower bends 42 of the biasing element 18. Although shown from the right hand side of chair assembly 10 relative to a user seated thereupon, it should be appreciated that the left and right hand lateral sides of seat assembly 10 are generally mirror images of one another such that each lateral side of chair assembly 10 includes respective first, second, third, and fourth pivots whose axes of rotation are coaxially aligned with one another, respectively.

When a user attempts to transition the chair assembly 10 from the upright position 52 to the reclined position 60, the back 16 rotates about the pivot joints 62 in a first direction. That is, the back 16 of the chair assembly 16 rotates relative to the respective leg portions 30 about the axis associated with the first pivot point 84.

In turn, the pivot joints 56 disposed at the lower portion 58 of the back 16 also move about the pivot joint 62. As a result of the movement described above, the rear portion 54 of the seat 14 of the chair assembly 10 is raised to accommodate the movement of the pivot joints 56. That is, rotation of the back 16 about the first pivot point 84 causes movement of the second pivot point 86, resulting in movement of the seat 14 in relation to the second pivot point 86.

Due to the movement of the seat 14 coinciding with the second pivot point 86, the front portion 36 of the seat 14 moves about the third pivot point 88. Likewise, movement of the front portion 36 of the seat 14 about the third pivot point 88 causes movement of the biasing element 18 itself about the fourth pivot point 90. The pivoting about the third and fourth pivot points 88, 90 causes increased tension in the biasing element 18 between the respective upwardly oriented and lower oriented respective portions thereof.

As shown by comparing FIGS. 6 and 7, when the chair assembly 10 is transitioned to the reclined position 60, the pivoting about the third and fourth pivot points 88, 90 results in the flexing or bending of the biasing element 18 in certain locations, such as the generally vertically oriented extension portion 44. The flexing or bending of the biasing element 18, or a portion of the flexure thereof, may also occur proximate the lower bend 42 and the base portion 38. The above described flexing and bending of the biasing element 18 may affect the pivoting about the fourth pivot point 90 such that, in some embodiments of the invention, the fourth pivot point 90 is provided as a virtual pivot point that is spaced apart from the lower bend 42. That is, when provided in such a configuration, first, second, and third pivot points 84, 86, 88 may act as axially oriented pivot points whereas the axis of rotation or pivoting associated with biasing element 18 is associated with a location that is not otherwise associated with providing a physical rotational axis between discrete structures but facilitates motion via flexure of respective portion(s) of element 18.

In addition, movement of the seat 14 coinciding with the axis of rotation associated with the second pivot point 86 and the third pivot point 88, allows the first end 73 of the support extension 74 to transition in a direction away from the inner end 13 of the channel 15 which translation is accommodated by expansion of the flex member 17.

When in the reclined position 60, the biasing element 18 has increased tension due to the movement of elements about the pivot points. As a result, the chair assembly transitions itself toward the at-rest or upright position 52—as shown in FIG. 6—when a user is not present or is present but not actively applying a laterally directed force or pressure to the back 16.

As discussed above, FIG. 6 depicts a side view of the chair assembly 10 in the upright position 52. It is contemplated that the upright position 52 is the neutral or at-rest position of the chair assembly 10. That is, the upright position 52 is the relative orientation of the chair assembly 10 without any outside force applied to the chair assembly 10.

FIG. 7 depicts a side view of the chair assembly 10 when oriented in the reclined position 60. That is, a user can apply a force to the back 16 of the chair assembly 10 to transition it from the upright position 52 to the reclined position 60. Without an outside force applied to the chair assembly 10, the biasing element 18 of the chair assembly 10 will transition the chair assembly 10 back to the upright position 52.

Chair assembly 10 is constructed to be stackable in a manner customary to similarly constructed chair assemblies yet also constructed to provide a reclined orientation of the back relative to the seat portion of the assembly and in a manner that allows the seat of the chair assembly, and preferably a forward edge thereof, to translate in a somewhat upward and forward direction relative to the back of the chair assembly and so as to provide support for the back of the legs of users seated thereupon to achieve a more comfortable and ergonomic configuration of the chair assembly with respect to a seated and reclined user.

FIGS. 6-8 further illustrate the construction of the seat 14 and back 16 of the chair assembly 10. In the representative embodiment of the invention, the seat 14 is a multi-part assembly including a seat rest 14*a* and a seat shell or seat support 14*b*. In other embodiments of the invention, the seat 14 may include any number of elements other than the two (2) elements 14*a*, 14*b* shown in FIGS. 6-8. The seat rest 14*a* forms the upper portion of the seat 14 and an upper surface 98 upon which a user may sit. In varying embodiments of the invention, the seat 14 and back 16 may each be constructed from a variety of materials, such as, but not limited to wood, other fibrous materials, plastic, other polymers, metal, etc.

As shown in FIGS. 6 and 8, the support extension 74 described above is aligned with a bottom surface 14*c* of the seat shell 14*b*, when the chair assembly 10 is in the unloaded or upright position. That is, the support extension 74 does not extend below the bottom surface 14*c* of seat shell 14*b* when no one is sitting in the chair assembly 10. As a result, support extension 74 does not interfere with an efficient stacking of the chair assemblies 10.

The seat support 14*b* forms the lower portion of the seat 14 and the lower surface 46 of the seat 14. The seat support 14*b* provides additional rigidity or support for the seat 14 and also provides the channel 15 formed therein associated with receiving flex member 17 disposed within the channel 15 as disclosed above. As shown in FIGS. 6-8, the seat support 14*b* extends along the seat rest 14*a* from the pivot joint 56 to the front portion 36 of the seat 14 while ending before a front edge 37 of the seat 14. In other embodiments of the invention, the seat support 14*b* may extending along any portion of the seat rest 14*a*, including, but not limited to, all the way to the front edge 37 of the seat 14. Alternatively, seat support 14*b* may be constructed to extend about a portion or the entirety of a perimeter portion of the seat 14.

Similarly, the back 16 may also be either of a unitary or a multi-part assembly including a back rest 16*a* and a back support 16*b*. While FIGS. 6-8 depict the back 16 having two (2) elements 16*a*, 16*b*, other embodiments of the invention may include any number of elements including a single element. The back rest 16*a* forms the inner portion of the back 16 and an inner surface 100 upon which a back, or chest, of a user may rest.

The back support 16*b* forms the outer portion of the back 16. In the representative embodiment of the invention, the back support 16*b* extends along the back rest 16*a* from pivot joints 56, 62 to a location approaching the mid-point of the back 16. In varying embodiments of the invention, the back support 16*b* may extend along any portion of the back rest 16*a* or discrete portions of the perimeter associated therewith. For example, it is contemplated that the back support 16*b* may extend to a top edge 102 of the back 16.

Figure 9:
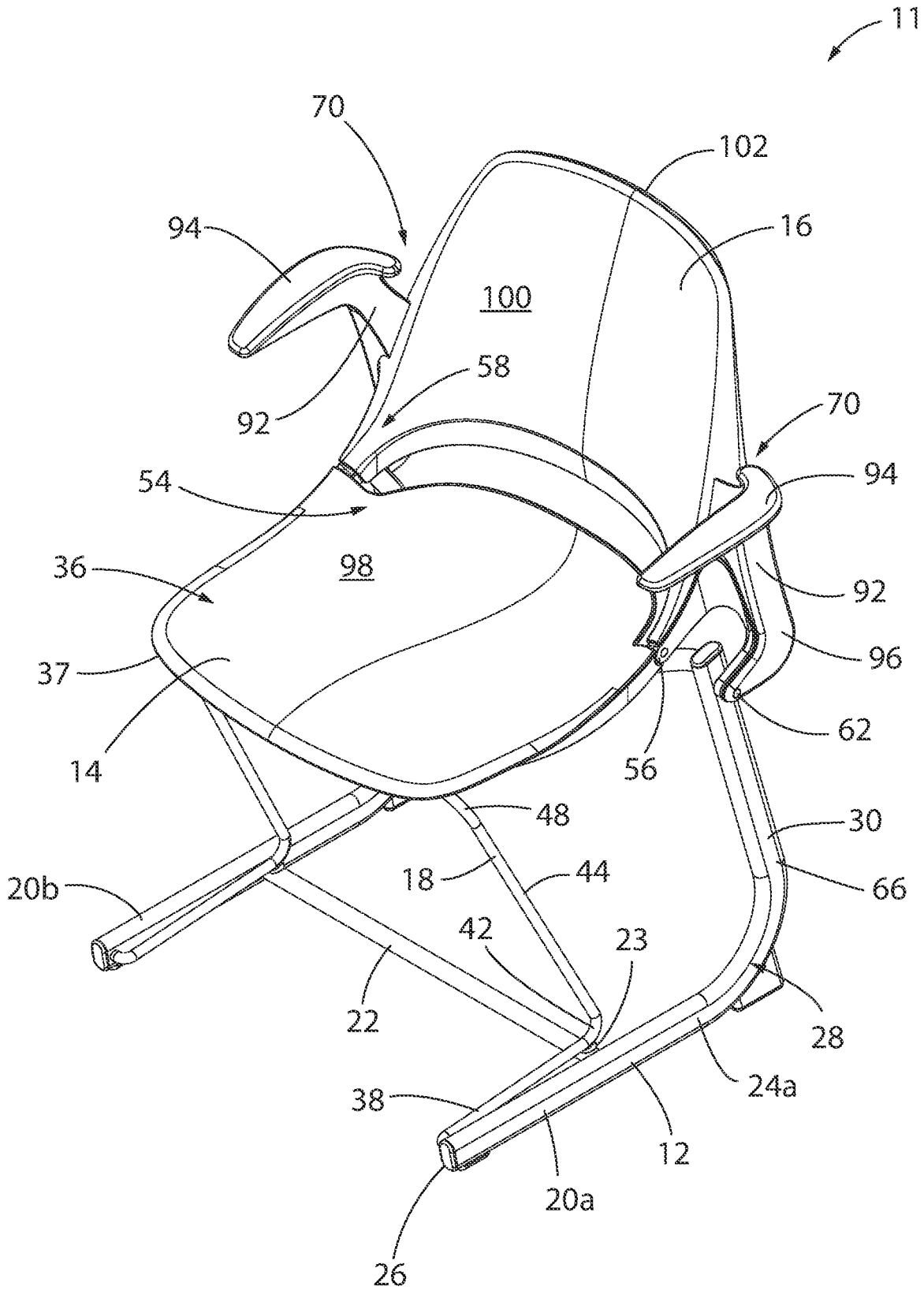
FIG. 9 is a perspective view of a chair assembly according to another aspect of the present application.

Referring to FIG. 9, another embodiment of the chair assembly 11 is shown. In such an embodiment, chair assembly 11 may include each of the features described above with respect the chair assembly 10 of FIGS. 1-8 with the addition of one or more discrete arm rest structures or simply arms 92 coupled to one or each side 70 of the back 16. Each arm 92 may include an arm rest element 94 oriented perpendicular or substantially horizontal when the chair assembly 11 is in the upright position 52. Further, the arm rest elements 94 are positioned at a location consistent with comfortably supporting the forearm of the average user. In varying embodiments of the invention, the arm rest element 94 may be adjustable in multiple directions, such as, but not limited to, the arm rest element 94 may extend horizontally, transition vertically, and tilt so as to adjust to any angle with respect to horizontal.

As shown in FIG. 9, each arm 92 may further include a support element 96 that extends parallel to and is coupled to the respective side 70 of the back 16 along the entire length of the extension member 68. In other embodiments of the invention, the support element 96 may extend partially along the length of the extension member 68. As arms 92 are coupled to back 16, it is contemplated that the arms 92 transition with back 16 between the upright and reclined positions 52, 60. It should be further appreciated that arms 92 could alternatively be supported by seat 14 and supported thereby so as to similarly translate during transition of chair assembly 11 between the upright or at rest orientation and the reclined orientation, respectively. It is further appreciated that the one or more arms 92 associated with chair assembly 11 are located laterally outboard relative to the horizontal foot print defined by seat 14 and back 16 so as to not appreciably detract from the stackable or nestable nature of chair assembly 11 when not in use.

Figure 10:
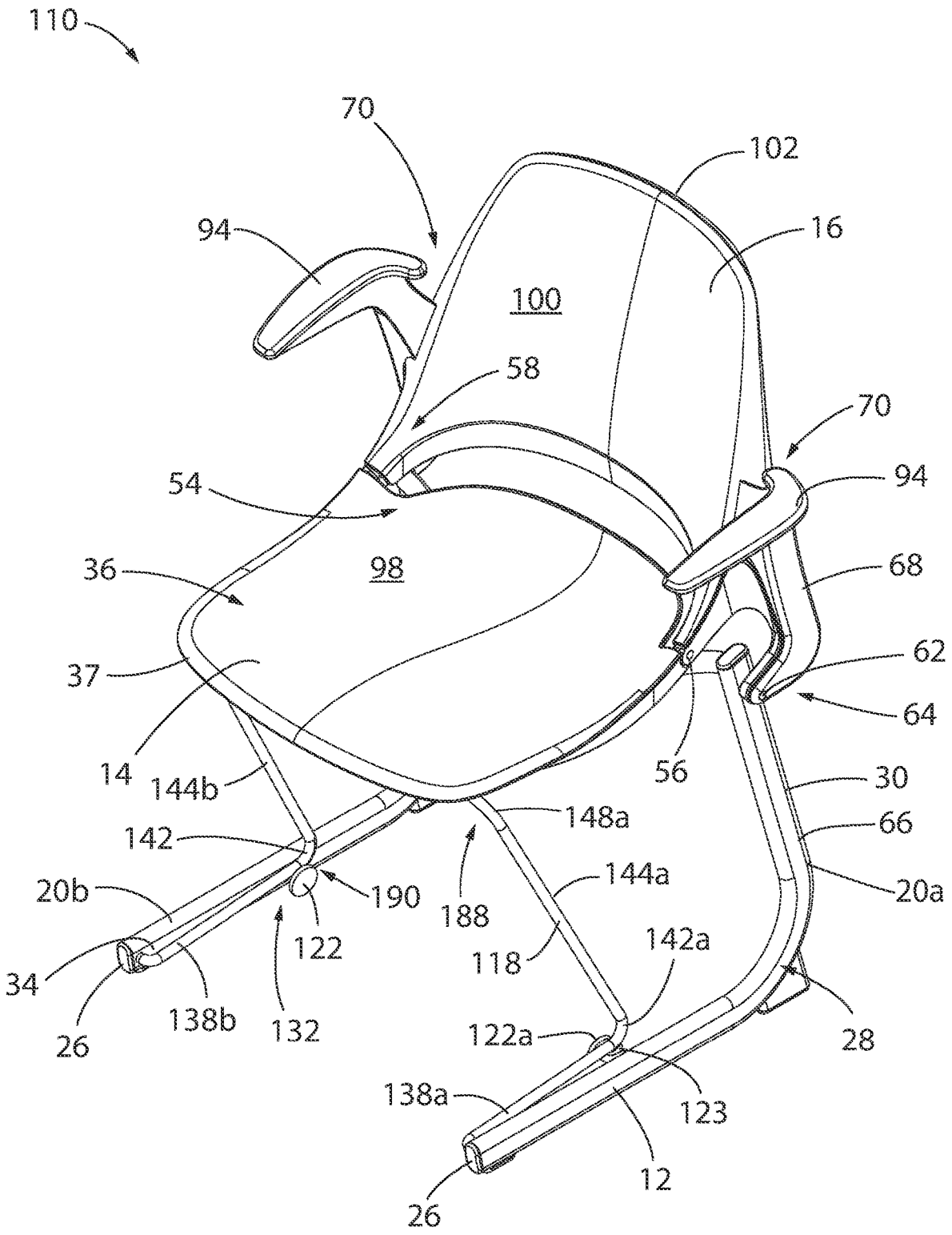
FIG. 10 is a perspective view of a chair assembly according to yet another aspect of the present application.

Referring next to FIG. 10, a chair assembly 110 is shown according to another embodiment of the invention. Chair assembly 110 includes many of the same features described above with respect to chair assembly 10 of FIGS. 1-8 and chair assembly 11 of FIG. 9 wherein like reference numbers are used therein. Unlike chair assemblies 10, 11, chair assembly 110 depicts an embodiment of the invention with an alternative biasing element 118 and an alternative support member 122. In this representative embodiment of the invention, biasing element 18 has been replaced with biasing element 118 and crossbar 22 has been replaced with protrusions 122.

As previously described, each leg 20 includes base portion 24 with first and second ends 26, 28. The biasing element 118 extends from an inner surface 34 of each leg 20 to a front portion 26 of the seat 14. As shown in FIG. 10, the biasing element 118 is coupled to the inner surface 34 of each leg 20 at a location adjacent the first end 26 of the base portion 24 of the leg 20. The biasing element 118 includes base portions 138, lower bend portions 142, extensions portions 144, upper bend portions 148, and a raised portion 150. The base portion 138 extends from leg 20 and toward a protrusion 122 extending from inner surface 34 of leg 20 at a location between the first and second ends 26, 28 of base portion 24 of leg 20. In turn, base portion 138 may either rest upon or be spaced apart from protrusion 122. In FIG. 10, a spacer 123 is disposed between the biasing element 118 and the protrusion 122. At a location adjacent protrusion 122, the biasing element 118 may transition from base portion 138 to extension portion 44 by way of lower bend section 142. At a location adjacent the seat 14, the biasing element 118 may then transition from lower bend section 142 to raised portion 150 by way of upper bend section 148. In the representative embodiment of the invention, the raised portion 150 is oriented along a horizontal plane extending under the seat 14.

Pivot points or axes 188, 190 coincide with previously discussed third and fourth pivot points or axes 88, 90, respectively. That is, pivot point 188 is disposed at the upper bend portion 148 of the biasing element 118, and pivot point 190 is disposed at the lower bend portion 142 of the biasing element 118.

As shown in FIG. 10, the above described base portion 138, lower bend portion 42, extension portion 44, and upper bend section 148 of the biasing element 118 are associated with each leg 20*a*, 20*b*. That is, the biasing element 118 of the representative embodiment of the invention includes two (2) base portions 138, two (2) lower bend sections or portions 142, two (2) extension sections or portions 144, two (2) upper bend sections or portions 148, and one (1) raised section or portion 150. In other embodiments of the invention, the biasing element 118 may include other numbers of discrete portions 138, 142, 144, 148, 150. In such embodiments of the invention, each protrusion 122*a*, 122*b* may extend any distance inward from the inner surface 34 of its respective leg 20*a*, 20*b* to accommodate additional portions. Preferably, protrusions 122*a*, 122*b* are constructed so as to facilitate and not otherwise interfere with the nestable or stackable performance associated with a plurality of chair assemblies 110.

Figure 11:
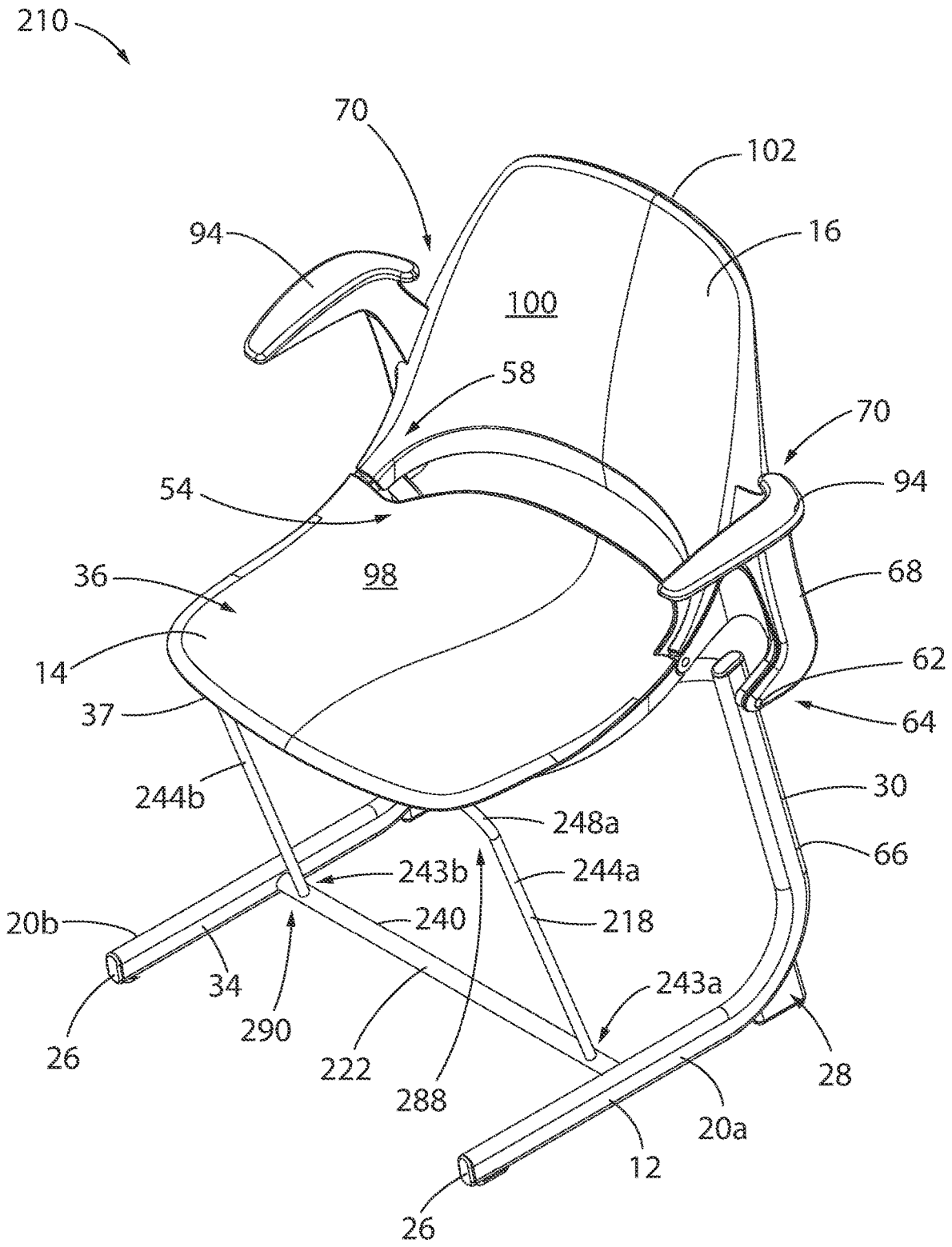
FIG. 11 is a perspective view of a chair assembly according to another aspect of the present application.

FIG. 11 depicts a chair assembly 210 according to another embodiment of the present application. Chair assembly 210 includes many of the same features as the previously described chair assemblies 10, 11, 110 and the same operational nature of the chair assemblies as disclosed above, however chair assembly 210 includes an alternative biasing element 218. Similar to chair assemblies 10, 11, a support member 222 in the form of a crossbar 222 extends between the inner surfaces 34 of the base portions 24*a*, 24*b* of each leg 20*a*, 20*b*. The biasing element 218 includes extension portions 244, upper bend portions 248, and raised portion 250. The extension portion 244 extends from a distal end 243 to upper bend portion 248. At upper bend portion 248 and adjacent seat 14, the biasing element 218 transitions from extension portion 244 to raised portion 250. Raised portion 250 extends horizontally under the seat 14 from one upper bend portion 248*a* to another upper bend portion 248*b*. Distal ends 243 of the extension portions 244 are attached to a top surface 240 of crossbar 222.

In this embodiment of the invention, pivot points or axes 288, 290 replace third and fourth pivot points or axes 88, 90, respectfully, discussed with respect to FIGS. 1-9. The third pivot point 288 is disposed at the upper bend portions 248. Meanwhile, the fourth pivot point 290 is disposed at the distal ends 243 of the biasing element 218. In this embodiment of the invention, the fourth pivot point 290 is stationary, as it is disposed at the distal ends 243 of the biasing element 218, which are attached to the top surface 240 of the crossbar 222.

In the representative embodiment of FIG. 11, the biasing element 118 includes portions 244*a*, 244*b*, 248*a*, 248*b* associated with each leg 20*a*, 20*b*. In other words, the biasing element 18 includes two (2) extension portions 244, two (2) upper bend portions 248, and one (1) extension portion 150. However, other embodiments of the invention may independently include any number of extension portions 244, upper bend portions 248, and extension portions 250. Additional extension portions 244 may also be coupled to top surface 240 of crossbar 222 at distal ends 243.

Figure 12:
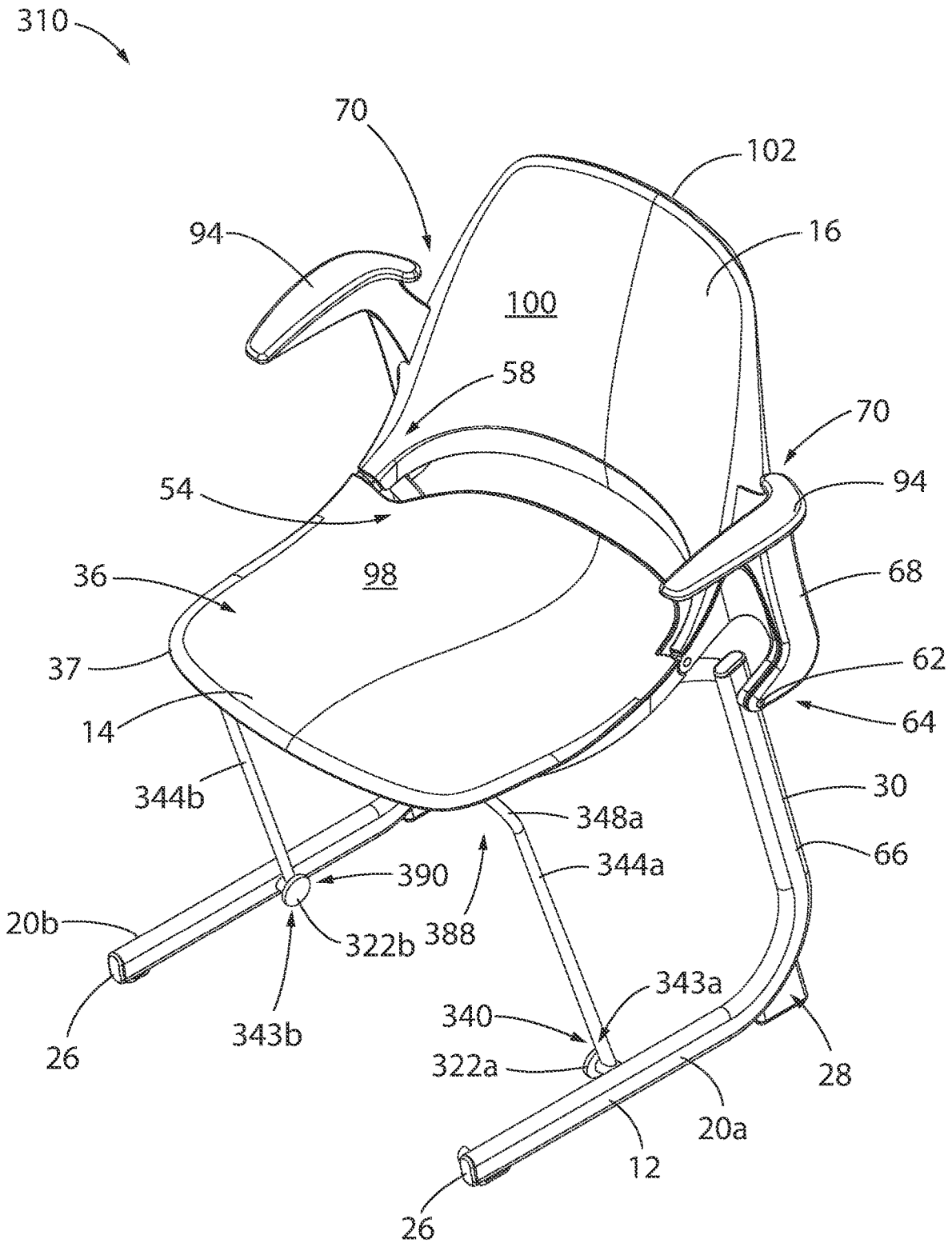
FIG. 12 is a perspective view of a chair assembly according to yet another aspect of the invention.

FIG. 12 depicts yet another chair assembly 310 according to another embodiment of the application and which includes many of the same structural and operational features as chair assemblies 10, 11, 110, 210. Unlike chair assemblies 10, 11, 110, 210, chair assembly 310 includes an alternative biasing element 318 in place of biasing element 18 and a support member 322 in the form of protrusions 322 in place of crossbar 22. Protrusions 322 extend inward from the inner surface of base portions 24*a*, 24*b* of each leg 20*a*, 20*b* at a location between first and second ends 26, 28. The biasing element 318 includes extension portions 344, upper bend portions 348, and raised portion 350 extending horizontally under seat 14 and between upper bend portions 348. Distal ends 343 of each extension portion 344 are attached to a top surface 340 of a respective protrusion 322.

As shown in FIG. 12, pivot point or axis 388 replaces third pivot point or axes 88 associated with the chair assemblies as shown in FIGS. 1-9, while pivot point or axis 390 replaces fourth pivot point or axes 90 shown therein. In turn, third pivot point 388 is disposed at the upper bend portions 348. Meanwhile, fourth pivot point 390 is disposed at the distal ends 343 of the biasing element 318. Since the fourth pivot point 390 is disposed at the distal ends 343 of the biasing element, which are attached to the top surface 340 of the protrusions 322, the fourth pivot point 390 is stationary.

In the representative embodiment of the invention, the biasing element 318 includes extension portions 344*a*, 344*b* and upper bend portions 348*a*, 348*b* associated with each leg 20*a*, 20*b*. As such, the biasing element 318 of FIG. 12 includes two (2) extension portions 344, two (2) upper bend portions 348, and one (1) extension portion 350. It is appreciated that other embodiments of the invention may include other numbers of extension portions 344, other numbers of upper bend portions 348, and other numbers of extension portions 350, aside from those shown. In embodiments of the invention having more portions 344, 348 than legs 20, one or more protrusions 322 may extend any distance inward from the inner surface 34 of its respective leg 20 in order to accommodate extra portions 344, 348.

It should be understood that the above description, while indicating representative embodiments of the present invention, is given by way of illustration and not of limitation. Many changes and modifications may be made within the scope of the present invention without departing from the spirit thereof, and the invention includes all such modifications. Various additions, modifications, and rearrangements are contemplated as being within the scope of the following claims, which particularly point out and distinctly claim the subject matter regarding as the invention, and it is intended that the following claims cover all such additions, modifications, and rearrangements.

What is claimed is:

1. A chair assembly comprising:
a leg assembly comprising:
a plurality of legs; and
a crossbar extending between at least two of the plurality of legs;
a back that is rotatably coupled to the leg assembly via a first pivot axis;
a seat rotatably coupled to the back via a second pivot axis;
a biasing element that extends between the leg assembly to the seat, the biasing element comprising:
a plurality of base portions that are coupled to a respective one of the plurality of legs;
a lower bend section that transitions each base portion to an extension portion;
an upper bend section that transitions each extension portion to a raised portion disposed proximate the seat;
wherein the upper bend section defines a third pivot axis; and
wherein the lower bend section defines a fourth pivot axis.

2. The chair assembly of claim 1 wherein each leg of the plurality of legs comprises a base portion having a first end and a second end and a leg portion extending upward at an angle relative to the base portion from the second end of the base portion.

3. The chair assembly of claim 2 wherein each base portion of the biasing element is coupled to an inner surface of the base portion of a respective leg.

4. The chair assembly of claim 1 wherein the raised portion of the biasing element is adjacent a front portion of the seat.

5. The chair assembly of claim 1 wherein a force applied to the back causes the back to pivot about the first pivot axis, the back and seat to pivot about the second pivot axis, the seat and biasing element to pivot about the third pivot axis, and the biasing element to pivot about the fourth pivot axis.

6. The chair assembly of claim 5 wherein an elevation of a front portion of the seat increases relative to an at rest orientation of the front portion of the seat when the seat pivots about the second pivot axis.

7. The chair assembly of claim 1 further comprising:
a crossbeam extending between at least two of the plurality of legs;
a support extending from the crossbeam to a channel formed in a lower surface of the seat, a first end of the support disposed within the channel;
a flex member disposed within the channel and between the first end of the support and an inner edge of the channel, wherein a first end of the flex member is coupled to the inner edge of the channel and a second end of the flex member is coupled to the first end of the support
wherein the flex member expands to displace the first end of the support from the inner edge of the channel and contracts to bring the first end of the support and the inner edge of the channel closer together.

8. A chair assembly comprising:
a leg assembly comprising:
a plurality of legs; and
at least one support member extending inward from at least two of the plurality of legs;
a back that is rotatably coupled to the leg assembly via a first pivot axis;
a seat rotatably coupled to the back via a second pivot axis;
a biasing element that extends between the leg assembly to the seat, the biasing element comprising:
a raised portion extending horizontally under the seat;
a plurality of upper bend portions that transitions the raised portion to a plurality of extension portions;
wherein each extension portion extends from a respective upper bend portion to a location adjacent a respective support member an extension portion extending upward from the support member;
wherein the upper bend portions define a third pivot axis; and
wherein the location adjacent the at least one support member defines a fourth pivot axis.

9. The chair assembly of claim 8 wherein when the back pivots about the first pivot axis, the back and seat pivot about the second pivot axis, the seat and biasing element pivot about the third pivot axis, and the biasing element pivots about the fourth pivot axis.

10. The chair assembly of claim 8 wherein the biasing element further includes a plurality of lower bend portions that transition each extension portion to a base portion;
wherein the lower bend portions define the fourth pivot axis; and
wherein each base portion is coupled to an inner surface of a respective leg.

11. The chair assembly of claim 10 wherein each leg includes a base portion and a leg portion extending upward from an end of the base portion and at an angle relative to the base portion;
wherein each base portion of the biasing element is coupled to an inner surface of the base portion of the respective leg.

12. The chair assembly of claim 8 wherein an end of each extension portion of the biasing element is attached to a top surface of the at least one support member.

13. The chair assembly of claim 12 wherein the at least one support member is a crossbar extending between at least two of the plurality of legs.

14. The chair assembly of claim 12 wherein the at least one support member is a plurality of protrusions extending inward from at least two of the plurality of legs.

15. The chair assembly of claim 8 further comprising:

a crossbeam extending between at least two of the plurality of legs at a location adjacent a top end of each leg;

a channel formed in a lower surface of the seat;

a support coupled to the crossbeam and having a distal end extending into the channel;

a flex member coupled to and extending between the distal end of the support and an inner edge of the channel; and wherein pivoting of the chair assembly about the first, second, third, and fourth pivot axes causes the flex member to expand as the distal end of the support and the inner edge of the channel are displaced and causes the flex member to contract as the distal end of the support and the inner edge of the channel are brought closer together.

16. The chair assembly of claim 8 wherein the raised portion of the biasing element is located adjacent a front portion of the seat.

17. A chair assembly comprising:

a plurality of legs, wherein at least one leg includes a support member extending inward;

a back rotatably coupled to the leg assembly via first pivot axis;

a seat rotatably coupled to the back via a second pivot axis; and a biasing element extending from the seat at a third pivot axis to a location adjacent the support member at a fourth pivot axis, the biasing element including:

a plurality of extension portions coupled to and extending upward from the support member; and an upper bend portion transitioning each extension portion to a raised portion disposed at the seat and extending horizontally between the upper bend portions.

18. The chair assembly of claim 17 wherein the biasing element includes:

a plurality of base portions coupled to a base portion of at least two of the plurality of legs;

a lower bend portion transitioning each base portion of the biasing element to an extension portion oriented upward at an angle from each base portion of the biasing element; and an upper bend portion transitioning each extension portion to a raised portion disposed at the seat and extending horizontally between the upper bend portions;

wherein the lower bend portion is disposed adjacent the supper member.

19. The chair assembly of claim 17 wherein a force applied to the back causes the back to pivot about the first pivot axis, the back and seat to pivot about the second pivot axis, the seat and biasing element to pivot about the third pivot axis, and the biasing element to pivot about the fourth pivot axis.

* * * * *